US007371152B1

(12) United States Patent
Newman

(10) Patent No.: US 7,371,152 B1
(45) Date of Patent: May 13, 2008

(54) NON-UNIFORM SUBAPERTURE POLISHING

(75) Inventor: Clayton R. Newman, Pleasanton, CA (US)

(73) Assignee: Western Digital (Fremont), LLC, Fremont, CA (US)

( * ) Notice: Subject to any disclaimer, the term of this patent is extended or adjusted under 35 U.S.C. 154(b) by 0 days.

(21) Appl. No.: 11/644,856

(22) Filed: Dec. 22, 2006

(51) Int. Cl.
*B24B 49/00* (2006.01)

(52) U.S. Cl. ..... 451/11; 451/10; 451/41; 451/160; 451/285

(58) Field of Classification Search ..... 451/10, 451/11, 41, 63, 158, 160, 285, 287; 257/E21.23
See application file for complete search history.

(56) References Cited

U.S. PATENT DOCUMENTS 6,033,290 A * 3/2000 Gurusamy et al. ..... 451/56
6,540,587 B1 * 4/2003 Gotkis et al. ..... 451/5
6,585,572 B1 7/2003 Saldana et al.
6,958,005 B1 * 10/2005 Charatan ..... 451/56
2001/0009843 A1 * 7/2001 Hirokawa et al. ..... 451/160
2002/0188370 A1 * 12/2002 Saldana et al. ..... 700/121
2006/0151110 A1 * 7/2006 Laursen et al. ..... 156/345.12

FOREIGN PATENT DOCUMENTS

WO WO 02/24410 A1 3/2002

* cited by examiner

*Primary Examiner*—Eileen P. Morgan
(74) *Attorney, Agent, or Firm*—Jonathan E. Prejean, Esq.

(57) ABSTRACT

A method for subaperture polishing includes determining a first portion of a sample to be polished disproportionately compared to a second portion of the sample. Based on the determination of the first portion, a sweep frequency that is a first rate of lateral motion for a polishing pad is selected to be substantially equal to an integer multiple of a rotation frequency that is a rate of rotation for the sample. The method further includes rotating the polishing pad at the polishing frequency, rotating the sample at the rotation frequency, and polishing the sample using the polishing pad while rotating the polishing pad and the sample.

16 Claims, 2 Drawing Sheets

NON-UNIFORM SUBAPERTURE POLISHING

FIELD OF THE INVENTION

The present invention relates to subaperture polishing, and more particularly, to a method and system for non-uniform subaperture polishing.

BACKGROUND

Subaperture polishing techniques are useful for preventing difficulties associated with using polishing pads of roughly the same size as a sample being polished. For example, there can be edge effects resulting from the pad making contact with the edges. This can create "pad rebound", wherein the pad repeatedly bounces off of the sample, or "burn off," wherein the contact area with the pad is disproportionately small so that too much material is worn away. The use of subaperture techniques, using a pad smaller than the sample that is swept from an edge to a middle region of the sample, can reduce or even eliminate some of these drawbacks. Conventional systems use a uniform polishing rate to produce uniform profiles for flat surfaces. In cases, where non-uniform profiles are desired, the sample and one or more polishing heads may be moved relative to one another to differentially polish different areas of the sample.

SUMMARY

In a particular embodiment of the present invention, a method for subaperture polishing includes determining a first portion of a sample to be polished disproportionately compared to a second portion of the sample. Based on the determination of the first portion, a sweep frequency that is a first rate of lateral motion for a polishing pad is selected to be substantially equal to an integer multiple of a rotation frequency that is a rate of rotation for the sample. The method further includes rotating the polishing pad at the polishing frequency, rotating the sample at the rotation frequency, and polishing the sample using the polishing pad while rotating the polishing pad and the sample.

In another embodiment of the present invention, an apparatus for subaperture polishing includes a stage for holding a sample and a polishing head. The stage rotates at a rotation frequency. The polishing head moves laterally at a sweep frequency substantially equal to an integer multiple of the rotation frequency. The polishing head includes a polishing pad having a characteristic dimension smaller than the sample. The polishing head is moved relative to the stage. A first portion of the sample is disproportionately polished by the polishing pad relative to a second portion of the sample when the polishing head is swept at the sweep frequency and the stage is rotated at the sample frequency.

DETAILED DESCRIPTION OF PREFERRED EXEMPLARY EMBODIMENTS

Figure 1:
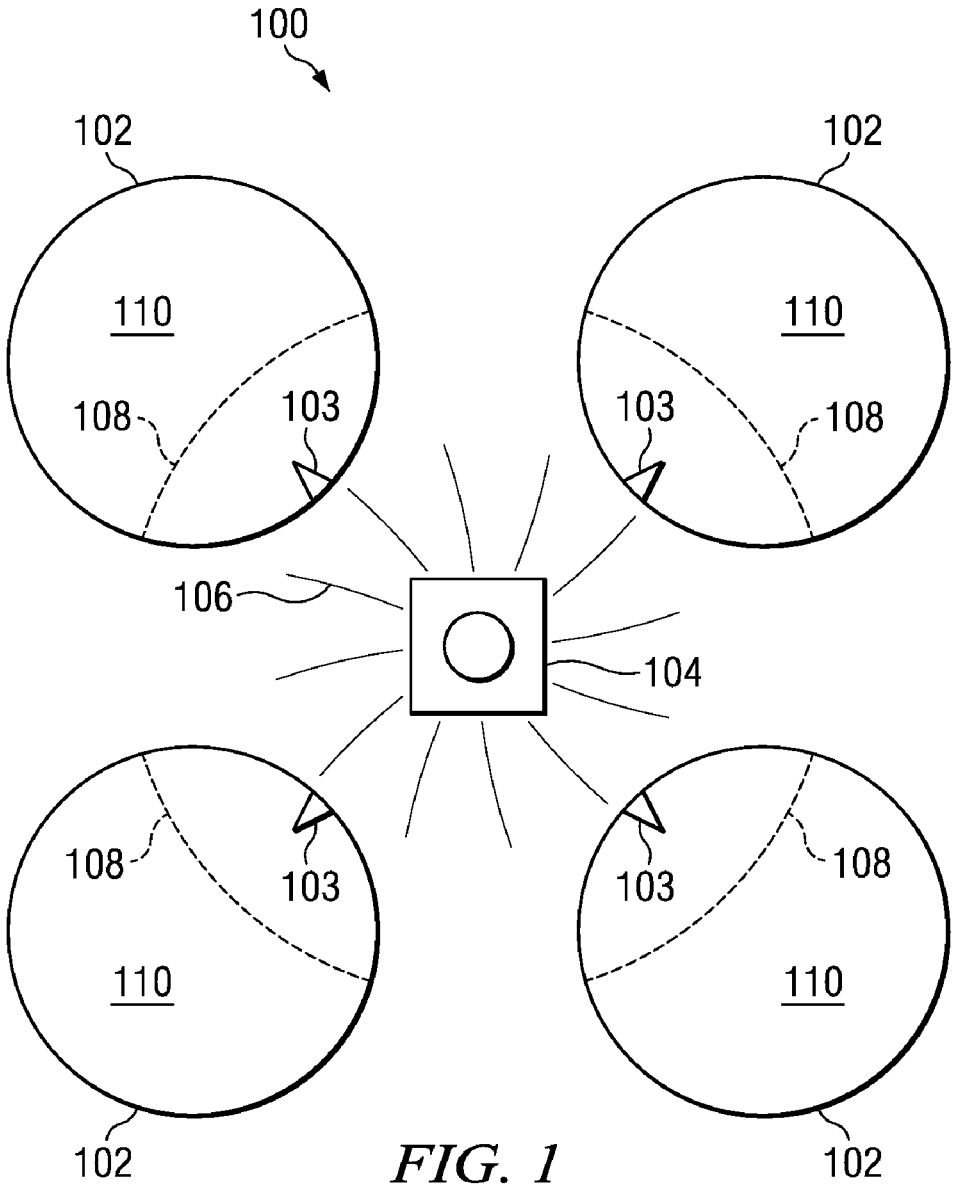
FIG. 1 depicts a deposition system for wafers suitable for subaperture polishing according to particular embodiments of the present invention.

FIG. 1 shows a deposition system 100 for samples 102 that may be polished using subaperture polishing. In the depicted embodiment, a source 104 produces a particle flux 106 that is deposited on samples 102. Samples 102 may include an orientation notch 103 that may be used to indicate the relative position of the samples 102 to the source 104. In a particular instance, for example, the notches 103 may be oriented so that the notches 103 are closest to the source 102, although the notches 103 could correspond to any orientation in principle. Differing amounts of flux 106 reach different positions on samples 102, meaning that there may be non-uniform deposition of material on samples 102. For example, samples 102 may have a high-deposition portion 108 nearer to the source 104 and a lower-deposition portion 110 farther away from the sample.

Figure 2:
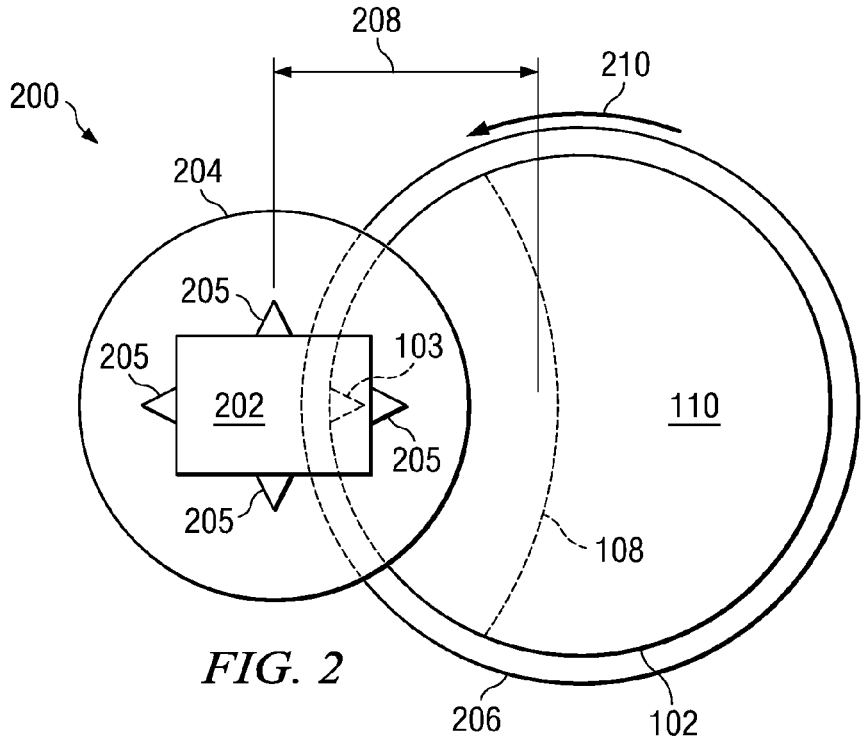
FIG. 2 depicts a polishing system used according to a particular embodiment of the present invention.

FIG. 2 is a schematic drawing of a polishing system 200 for polishing samples 102. Polishing system 200 includes a polishing head 202 with a polishing pad 204. Polishing head 202 is movable across the surface of the sample 102 from the edge of the sample to the middle of the sample. Polishing pad 204 may be any suitable material for smoothing the surface of the sample 102. The pad 204 is commonly formed from a flexible material, such as polyurethane. The material of the pad 204 is sometimes porous or fibrous, and it may include abrasives. A gimbal 205 may be used to provide a force to bias the pad 204 against the sample 102. In particular embodiments, a slurry, which may be supplied through a conduit in the polishing head 202, can be used to polish away material as well. The sample 102 is placed on a stage 206 that can rotate the sample 102 under the polishing head 202. Retaining rings, vacuum stages, or other suitable techniques may be used to hold the sample 102 in place.

Certain materials may be particularly difficult to polish away because of their hardness. For example, aluminum titanium carbide, a material frequently used in magnetic applications, is deliberately selected for its hardness to prevent damage, but this also makes it difficult to polish. Consequently, it may be particularly difficult to produce a uniform surface profile when the deposition of the hard material is non-uniform.

The depicted embodiment selects a sweep frequency 208 (illustrated as a motion between two positions) for the translation of the polishing head 202 relative to a rotation frequency 210 for the sample 102. In particular, the sweep frequency 206 is selected to be approximately equal to an integer multiple of the rotation frequency 210. In conventional systems, these frequencies are selected not to be multiples of one another in order that the surface received uniform polishing. When dealing with relatively soft materials, samples 102 may often be polished down sufficiently that the surface ends up being relatively uniform even if there is a non-uniform deposition of material on the sample 102. But because harder materials are more difficult to polish, this may not be the case. In such cases, it is desirable to disproportionately polish a high-deposition portion 108 of the sample 102 to produce a uniform surface. Based on the estimated degree of non-uniformity and the removal rate for the polishing process, which may include the hardness and thickness of the material to be removed, the time spent polishing the material can be adjusted so that the surface ends up being desirably uniform. The degree of non-uniformity may determined by modeling a deposition profile of material on the sample 102, by making nanometric measurements of the sample 102, or by any other suitable technique for determining the surface thickness of the surface layer at various locations. The starting position of the sample 102 at the beginning of the polishing process is selected by orienting the notch 103 so that more material is worn away in the high-deposition portion 108.

Figure 3:
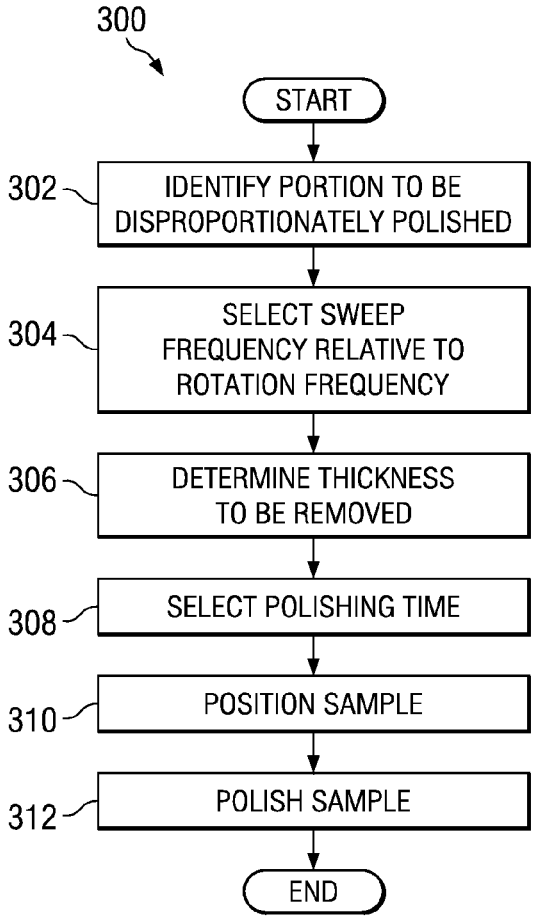
FIG. 3 is a flow chart depicting a method for subaperture polishing according to a particular embodiment of the present invention.

FIG. 3 is a flow chart 300 showing a method of subaperture polishing according to a particular embodiment of the present invention. At step 302, a portion of the sample 102 to be disproportionately polished is identified. A sweep frequency 208 for the polishing head 202 is selected to be an integer multiple of a rotation frequency 210 for the sample 102 at step 304. A thickness of additional material to be removed is determined at step 306. This determination may be made using any suitable technique, including modeling a deposition profile or nanometric measurements. Based on a removal rate of material and the frequency relationship between the sweep frequency 208 and the rotation frequency 210, a polishing time is selected at step 308. The sample 102 is oriented in a selected starting position on the stage 206 at step 310. The sample 102 is then polished according to the selected parameters at step 312. In other embodiments, particular steps of the method may be added, omitted, or rearranged. In particular, determinations about the thickness of material to be removed, the frequency relationship between the sweep frequency 208 and the rotation frequency 210, and the polishing time may be determined concurrently or in a sequence other than what is specified.

What is claimed is:

1. A method for subaperture polishing, comprising:

determining a first portion of a sample to be polished disproportionately compared to a second portion of the sample;

based on the determination of the first portion, selecting a sweep frequency comprising a first rate of lateral motion for a polishing pad to be substantially equal to an integer multiple of a rotation frequency comprising a rate of rotation for the sample;

laterally sweeping the polishing pad at the polishing frequency;

rotating the sample at the rotation frequency; and while rotating the polishing pad and the sample, polishing the sample using the polishing pad.

2. The method of claim 1, wherein the sweep frequency is substantially equal to the sample frequency.

3. The method of claim 1, wherein the first portion is determined based upon a deposition profile of material on the sample.

4. The method of claim 1, wherein the first portion is determined based on nanometric measurements of a thickness of the sample.

5. The method of claim 1, wherein the sample comprises an orientation notch, and the method further comprises selecting a starting position for the polishing pad relative to the orientation notch.

6. The method of claim 1, further comprising supplying a slurry to the polishing pad during polishing.

7. The method of claim 1, wherein polishing is performed for a polishing time selected based at least partially on a thickness of material to be removed from the sample and a hardness of the material to be removed.

8. The method of claim 7, wherein the material to be removed comprises at least one of aluminum titanium carbide and alumina.

9. An apparatus for subaperture polishing, comprising:

a stage for holding a sample, the stage operable to rotate at a rotation frequency;

a polishing head operable to move laterally at a selected sweep frequency in response to a selector being set at the selected sweep frequency, the polishing head comprising a polishing pad having a characteristic dimension smaller than the sample; and, the selector set at the selected sweep frequency the selected sweep frequency being substantially equal to an integer multiple of the rotation frequency and the selected sweep frequency set such that a first portion of the sample is disproportionately polished by the polishing pad relative to a second portion of the sample when the polishing pad is swept at the selected sweep frequency and the stage is rotated at the sample frequency.

10. The apparatus of claim 9, further comprising a retaining ring operable to hold the sample on the stage.

11. The apparatus of claim 9, wherein the stage comprises a vacuum stage operable to hold the sample on the stage.

12. The apparatus of claim 9, wherein the polishing pad comprises polyurethane.

13. The apparatus of claim 9, further comprising a conduit in the polishing head configured to deliver slurry to the polishing pad.

14. The apparatus of claim 9, wherein the sweep frequency is substantially equal to the sample frequency.

15. The apparatus of claim 9, wherein a starting position of the polisher is selected relative to a position on the stage corresponding to an orientation notch of the sample.

16. The apparatus of claim 9, wherein the polisher comprises a gimbal providing a resilient bias force to the polishing pad.

* * * * *